US005832682A

United States Patent [19]

Hussel

[11] Patent Number: 5,832,682

[45] Date of Patent: Nov. 10, 1998

[54] CHIMNEY MOISTURE SEAL

[76] Inventor: William B. Hussel, 17698 Nassau Dr., Brookfield, Wis. 53045

[21] Appl. No.: 843,362

[22] Filed: Apr. 15, 1997

[51] Int. Cl.[6] ..... E04H 12/28

[52] U.S. Cl. ..... 52/218; 454/44; 285/123; 52/741.4

[58] Field of Search ..... 52/218, 219, 302.3, 52/741.4; 454/1, 44, 47; 285/123.12, 123.15, 123.16

[56] References Cited

U.S. PATENT DOCUMENTS

| | | | |
|---|---|---|---|
| 1,085,889 | 2/1914 | Carl | 454/1 X |
| 5,125,870 | 6/1992 | Kilian | 454/47 |

FOREIGN PATENT DOCUMENTS

| | | | |
|---|---|---|---|
| 628705 | 2/1963 | Belgium | 52/218 |
| 293397 | 8/1991 | German Dem. Rep. | 454/1 |
| 3147934 | 6/1983 | Germany | 52/218 |

*Primary Examiner*—Robert Canfield
*Attorney, Agent, or Firm*—Wheeler Kromholz & Manion

[57] ABSTRACT

A chimney moisture seal for use in combination with a chimney bounded by at least one wall of a building. The building having at least one roof having a predetermined level. The chimney having at least one end portion extending through the roof. The chimney including a veneer wall and a flue including a plurality of flue tiles coupled at a plurality of flue joints, an air space having a predetermined dimension located between said veneer wall and said flue, and a chimney cap mechanism located on said exterior end of said chimney and coupled to at least a portion of said flue and said veneer wall. The improvement being a moisture barrier structure mounted in the air space. The moisture barrier structure is positioned below the predetermined level of said roof. A method for preventing deterioration of an exterior veneer wall of a chimney structure. The method comprising mounting a moisture sealing mechanism and sealing a predetermined portion of said air space between said veneer wall and said flue.

29 Claims, 1 Drawing Sheet

CHIMNEY MOISTURE SEAL

BACKGROUND OF THE INVENTION

The present invention relates to the home and building construction industry, generally and specifically to a method and device for enhancing the life of a chimney. A modern chimney is composed typically of an exterior veneer wall made of brick held together with a masonry material such as concrete and an interior flue wall made of heat resistant material such as fiberglass tiles, ceramic tiles, etc. The exterior veneer wall may be made of any suitable material but the usual materials are brick and concrete based and somewhat porous. Construction codes generally require that the chimney flue wall be spaced away from the exterior wall of the chimney to present an air space of usually one-half inch to one inch between the veneer walls interior surface and the exterior surface of the flue wall that is surrounded by the veneer wall. The airspace allows the flue walls to expand as they heat up when the chimney is in use.

The flue walls, as noted above, are typically comprised of heat resistant tiles which are joined together at tile joint lines. The flue walls define the exhaust area and extend from the bottom of the chimney to the top of the chimney. Over time the joints of the flue wall become perforate. This allows exhaust vapors from a furnace, or other heat source to which the chimney is coupled, to intrude into the air space between the flue wall and the exterior wall of the chimney. This exhaust vapor from the furnace is usually moisture-laden. The air space between the flue wall and the exterior wall has no exhaust opening due to the fact that the exterior end of the chimney includes a chimney cap which covers the air space at the top of the chimney. Accordingly the moisture-laden air which intrudes through the deteriorated perforate joints of the flue becomes trapped between the exterior wall and the flue in the air space. The moisture from this air collects on and/or is absorbed into the porous material of the exterior wall.

Prior to the introduction of high efficiency furnaces the collection of moisture in the air space was not a significant problem because there was sufficient heat exiting the chimney so that the moisture in the exiting air would not evaporate and thus freeze. However, with the advent of higher efficiency furnaces, in temperate climates, the temperature of the exhaust air drops dramatically once the exhaust air rises above the roof line. This is not a problem with the portion of the exhaust air which exits through the opening in the chimney cap at the top of the chimney. With respect to the exhaust air trapped in the air space between the flue wall and the veneer wall, the moisture in the exhaust air condenses, collects, and freezes on the interior of the veneer wall. The freezing and expansion associated therewith creates cracks in the exterior veneer wall causing the exterior veneer wall to essentially deteriorate from the inside out. Further, when such cracking occurs, it makes the wall more susceptible to the outside elements and exacerbates the process of wall deterioration leading to problems like spaulding; (spaulding is the common name given to process by which pieces of brick flake away as a result of moisture problems).

To prevent these types of problems, it is necessary to repair the joints of the flue tiles. Such a repair of all the flue tile joints in a chimney is an expensive process. First, it is very difficult to repair those tiles that extend below the roof line. Second, in repairing the tiles that extend below the roof line, it is extremely expensive because portions of the chimney and the walls of the house may have to be taken apart to create openings to allow a repair person to get at those tiles and then those openings that were created to get to the tiles must be repaired.

However, it is relatively easy to repair the joints of the flue tiles which extend above the roof line. Accordingly, it is an object of the present invention to provide a method and device which may easily be installed just below the roof line of a house in the air space located between the exterior veneer wall and flue wall of a chimney to prevent moisture laden air from rising into that portion of the air space located above the roof line of the chimney and thereby avoiding expensive repairs to the joints of the flue located within the chimney and below the roof line of the house.

SUMMARY OF THE INVENTION

The present invention may generally be described as a device for use in combination with a chimney structure having an exterior end, a veneer wall structure, a flue structure, an air space located between said veneer wall structure and said flue structure, and a building having a roof. A predetermined portion of the chimney exterior end extends through the roof. The device comprises the improvement of a moisture sealing mechanism sealingly positioned in the air space between the veneer wall and the flue.

Preferably, but not necessarily, the moisture sealing mechanism is positioned in the air space just below the roof and is comprised of a heat resistant material like, but not limited to ceramic wool or fiberglass. Also, while the moisture sealing mechanism may be of any shape necessary to provide an effective barrier to exhaust air which may enter the air space it will typically comprise a ring, usually substantially rectangular, of at least one heat and moisture resistant material.

Alternatively, the present invention may be summarized as a device for use in combination with a chimney bounded by at least one wall of a building. The building having at least one roof having a predetermined level. The chimney having at least one end portion extending through said roof. The chimney including a veneer wall and a flue including a plurality of flue tiles coupled at a plurality of flue joints, an air space having a predetermined dimension located between the veneer wall and the flue, and a chimney cap mechanism located on the exterior end of the chimney and coupled to at least a portion of the flue and the veneer wall. The device being an improvement comprising a moisture barrier structure frictionally mounted in the air space.

Alternatively, the present invention may be described as a method for preventing deterioration of an exterior veneer wall of a chimney structure having an exterior end, a veneer wall structure, a flue structure, an air space located between the veneer wall structure and the flue structure, and a building having a roof, a predetermined portion of the chimney exterior end extending through the roof. The method including mounting a moisture sealing mechanism between the veneer wall and the flue and sealing off a predetermined portion of the air space.

DETAILED DESCRIPTION

Figure 1:
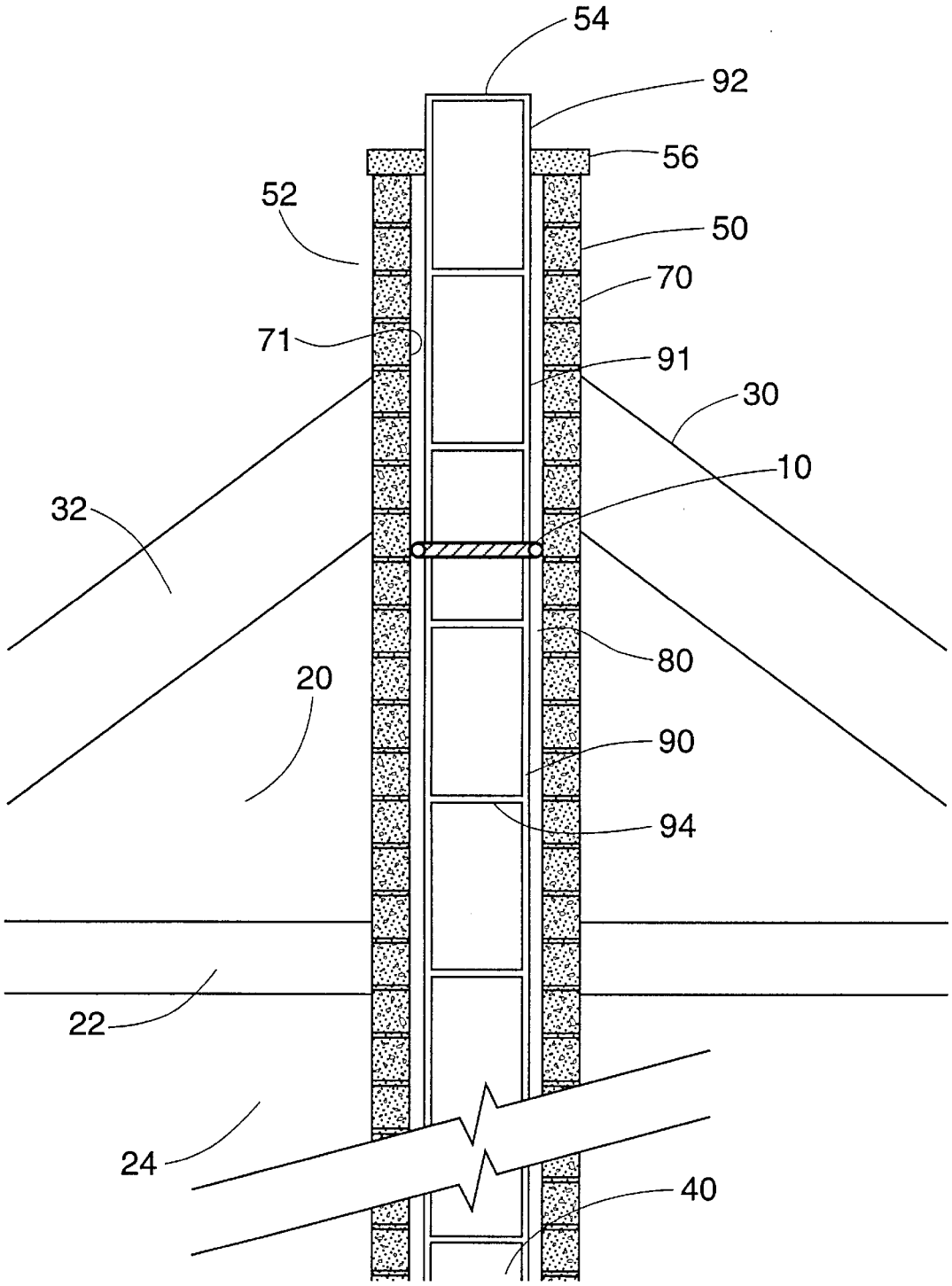
FIG. 1 is a plan view, partially cut away, showing the present invention in position in the air space located between the veneer wall and flue wall of a chimney.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to the FIGURE the present invention may be seen to be a chimney moisture seal 10. Presently, it is believed commercially preferable to construct the chimney moisture seal 10 from ceramic wool but other suitable substitute materials such as fiberglass and the like may be used.

Still referring to the FIGURE the chimney moisture seal 10 may be seen to be for use in combination with a chimney 50 which extends through a building having a roof 30, a roof rafter 32, an attic space 20, a ceiling 22, a living area 24, and a basement 40. The chimney 50 may be seen to extend up the interior of the building and through the roof 30. The chimney 50 includes an exterior end 52 located above the roof 30, an exhaust opening 54, a chimney cap 56, a brick veneer wall 70, and a flue 90. The flue 90 is located within the brick veneer wall 70 and includes flue tiles 92 which are joined in a known manner at flue joints 94.

Located between the brick veneer wall 70 and the flue tile 92 is an air space 80. The chimney moisture seal 10 is positioned in the air space 80 so that it is in sealing contact with interior 71 of the brick veneer wall 70 and the exterior 91 of the flue 90.

The air space 80 typically has a width of one-half inch to one inch and the chimney moisture seal 10 is of sufficient diameter to be frictionally mounted in the air space 80 although the chimney moisture seal 10 could also be fastened in place using a suitable fastening mechanism such as a mechanical mechanism like a nail or a staple or a non-mechanical mechanism such as an appropriate heat and moisture resistant adhesive. The chimney moisture seal 10 is positioned below the roof 30.

Accordingly, the present invention may be installed by removing the chimney cap 56, and if necessary a portion of the exterior end 52, and placing the chimney moisture seal 10 in tight frictional engagement with the interior 71 of the brick veneer wall 70 and the exterior 91 of the flue 90 just below the roof 30 of a building, typically a residential home.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. In combination with a chimney structure having an exterior end, a veneer wall structure, a flue structure, an air space located between said veneer wall structure and said flue structure, and a building having a roof, a predetermined portion of said chimney structure exterior end extending through said roof; the improvement comprising a moisture sealing mechanism, said moisture sealing mechanism being a single ring, sealingly positioned in said air space between said veneer wall and said flue structure.

2. The improvement of claim 1 wherein said moisture sealing mechanism is further positioned in said air space below and adjacent to said roof, whereby said moisture sealing mechanism serves to prevent a flow of moist air to pass above the roof within said air space.

3. The improvement of claim 1 wherein said moisture sealing mechanism is comprised of heat resistant material.

4. The improvement of claim 1 wherein said moisture sealing mechanism is comprised of ceramic wool.

5. The improvement of claim 1 wherein said moisture sealing mechanism is comprised of fiberglass.

6. The improvement of claim 1 wherein said moisture sealing mechanism comprises a substantially rectangular ring of at least one heat and moisture resistant material.

7. The improvement of claim 1 wherein said moisture sealing mechanism comprises a ring of at least one heat and moisture resistant material.

8. In combination with a chimney bounded by at least one wall of a building, said building having at least one roof having a predetermined level, said chimney having at least one end portion extending through said roof, said chimney including a veneer wall and a flue including a plurality of flue tiles coupled at a plurality of flue joints, an air space having a predetermined dimension located between said veneer wall and said flue, and a chimney cap mechanism located on an exterior end of said chimney and coupled to at least a portion of said flue and said veneer wall; the improvement comprising: a moisture barrier structure, said barrier structure being a single ring, mounted in said air space.

9. The improvement of claim 8 wherein the moisture barrier structure is positioned below and adjacent to the predetermined level of said roof, whereby the moisture barrier structure serves to prevent moist air from passing above the roof within said air space.

10. A method for preventing deterioration of an exterior veneer wall of a chimney structure having an exterior end, a veneer wall structure, a flue structure, an air space located between said veneer wall structure and said flue structure, and a building having a roof, a predetermined portion of said chimney structure exterior end extending through said roof; said method comprising: mounting a moisture sealing mechanism, said moisture sealing mechanism being a single ring, between said veneer wall and said flue structure and sealing a predetermined portion of said air space.

11. The method of claim 10 including mounting said moisture sealing mechanism in said air space adjacent to and below said roof, whereby said moisture sealing mechanism prevents a flow of moist air from passing above the roof within said air space.

12. The method of claim 10 wherein said moisture sealing mechanism is comprised of heat resistant material.

13. The method of claim 10 wherein said moisture sealing mechanism is comprised of ceramic wool.

14. The method of claim 10 wherein said moisture sealing mechanism is comprised of fiberglass.

15. The method of claim 10 wherein said moisture sealing mechanism comprises a substantially rectangular ring of at least one heat and moisture resistant material.

16. The method of claim 10 wherein said moisture sealing mechanism comprises a ring of at least one heat and moisture resistant material.

17. In combination with a chimney structure having an exterior end, a veneer wall structure, a flue structure, an air space located between said veneer wall structure and said flue structure, and a building having a roof, a predetermined portion of said chimney structure exterior end extending through said roof; the improvement comprising a moisture sealing mechanism, said moisture sealing mechanism being a single ring, sealingly positioned in said air space between said veneer wall and said flue structure and below said roof.

18. The improvement of claim 17 wherein said moisture sealing mechanism is comprised of heat resistant material.

19. The improvement of claim 17 wherein said moisture sealing mechanism is comprised of ceramic wool.

20. The improvement of claim 17 wherein said moisture sealing mechanism is comprised of fiberglass.

21. The improvement of claim 17 wherein said moisture sealing mechanism comprises a substantially rectangular ring of at least one heat and moisture resistant material.

22. The improvement of claim 17 wherein said moisture sealing mechanism comprises a ring of at least one heat and moisture resistant material.

23. In combination with a chimney bounded by at least one wall of a building, said building having at least one roof having a predetermined level, said chimney having at least one end portion extending through said roof, said chimney including a veneer wall and a flue including a plurality of flue tiles coupled at a plurality of flue joints, an air space having a predetermined dimension located between said veneer wall and said flue, and a chimney cap mechanism located on an exterior end of said chimney and coupled to at least a portion of said flue and said veneer wall; the improvement comprising: a moisture barrier structure, said barrier structure being a single ring, mounted in said air space below the predetermined level of said roof.

24. A method for preventing deterioration of an exterior veneer wall of a chimney structure having an exterior end, a veneer wall structure, a flue structure, an air space located between said veneer wall structure and said flue structure, and a building having a roof, a predetermined portion of said chimney structure exterior end extending through said roof; said method comprising: mounting a moisture sealing mechanism, said moisture sealing mechanism being a single ring, between said veneer wall and said flue structure below said roof and sealing a predetermined portion of said air space.

25. The method of claim 24 wherein said moisture sealing mechanism is comprised of heat resistant material.

26. The method of claim 24 wherein said moisture sealing mechanism is comprised of ceramic wool.

27. The method of claim 24 wherein said moisture sealing mechanism is comprised of fiberglass.

28. The method of claim 24 wherein said moisture sealing mechanism comprises a substantially rectangular ring of at least one heat and moisture resistant material.

29. The method of claim 24 wherein said moisture sealing mechanism comprises a ring of at least one heat and moisture resistant material.

* * * * *